United States Patent [19]

Inada

[11] 4,344,018

[45] Aug. 10, 1982

[54] HIGH PRESSURE METAL VAPOR DISCHARGE LAMP

[75] Inventor: Akio Inada, Tokyo, Japan

[73] Assignee: Hitachi, Ltd., Tokyo, Japan

[21] Appl. No.: 152,542

[22] Filed: May 23, 1980

[30] Foreign Application Priority Data

Jun. 18, 1979 [JP] Japan ..... 54-75716

[51] Int. Cl.[3] ..... H01J 7/44; H01J 13/46; H01J 19/78; H01J 29/96

[52] U.S. Cl. ..... 315/47; 315/49; 315/73; 315/104

[58] Field of Search ..... 315/47, 49, 73, 100, 315/104, DIG. 5, DIG. 7

[56] References Cited

U.S. PATENT DOCUMENTS

| | | | |
|---|---|---|---|
| 3,746,914 | 7/1973 | Olson et al. | 315/47 |
| 4,135,114 | 1/1979 | Narikiyo | 315/47 |
| 4,137,483 | 1/1979 | Ochi et al. | 315/47 |
| 4,258,288 | 3/1981 | Michael et al. | 315/73 |
| 4,316,122 | 2/1982 | Yamazaki et al. | 315/47 |

FOREIGN PATENT DOCUMENTS

| | | | |
|---|---|---|---|
| 1467050 | 12/1966 | France | 315/73 |

*Primary Examiner*—Saxfield Chatmon, Jr.
*Attorney, Agent, or Firm*—Kenyon & Kenyon

[57] ABSTRACT

A high pressure metal vapor discharge lamp according to the present invention comprises the following first and second starting aid circuits mounted within an outer envelope. The first starting aid circuit includes a starting aid and a first thermal switch, and the second starting aid circuit includes a resistive element and a second thermal switch. These two thermal switches are arranged so that at the time of re-starting after a certain period of stopping, the first thermal switch is reset earlier than the second thermal switch. In this high pressure metal vapor discharge lamp having this specific structure, the starting characteristic is improved, and a high voltage pulse generated by the second starting aid circuit and a ballast is assuredly absorbed by an arc tube and occurrence of dielectric breakdown in the respective elements can be completely prevented.

6 Claims, 2 Drawing Figures

HIGH PRESSURE METAL VAPOR DISCHARGE LAMP

BACKGROUND OF THE INVENTION (1) Field of the Invention

The present invention relates to a high pressure metal vapor discharge lamp. More particularly, the present invention relates to a high pressure sodium lamp having an improved starting circuit.

(2) Description of the Prior Art

A known high pressure sodium vapor discharge lamp typically has the following structure.

More specifically, electrodes are attached to both the ends of an arc tube consisting of an alumina ceramic pipe to seal both the ends of the arc tube, and sodium, mercury and an inert gas are confined in the arc tube and the arc tube is arranged within an outer envelope.

In the early stage, a discharge lamp including Xe gas as the inert gas confined therein under about 20 Torr was used. Although this discharge lamp has a relatively high luminous efficacy of about 120 lm/w, the voltage necessary for starting the lamp is as high as about 4500 V and therefore, an exclusive ballast including a pulse generator arranged therein should be used as a starting circuit.

Then, a discharge gas including Ne-Ar (that is, penning gas) as the inert gas confined therein under about 20 Torr to reduce the starting voltage was developed. The luminous efficacy of this discharge lamp is relatively low and is about 100 lm/w. However, the voltage necessary for starting the lamp is as low as about 250 V and an expensive ballast need not be used as the starting circuit.

However, if it is intended to use conveniently this discharge lamp as a substitute of a 200 V high pressure mercury lamp customarily used, the starting voltage is still too high and an inclusive ballast should inevitably used as the starting circuit.

As means for moderating this disadvantage, there was proposed a starting aid for lowering the starting voltage (see, for example, U.S. Pat. No. 4,037,127). According to this proposal, a starting aid conductor such as a metal is mounted on the periphery of an arc tube adjacently or contiguously to the outer wall of the arc tube, and the conductor is connected to a lead-in line communicating with one electrode through a thermal switch and is brought close to the other electrode maintained at a potential opposite to that of said one electrode, whereby the starting voltage of the discharge lamp is lowered. By using this starting aid, it was possible to lower the starting voltage to about 160 V. This value means that the discharge lamp can be sufficiently started by a customary ballast for the conventional 200 V high pressure mercury lamp.

Recently, however, development of a discharge lamp having a much improved luminous efficiency has been desired, and as the discharge lamp satisfying this desire, there was proposed a discharge lamp including Xe gas confined therein under about 350 Torr (see Japanese Patent Application Laid-Open Specification No. 129468/78). The luminous efficacy of this discharge lamp is very high and is about 140 ml/w. However, the starting voltage of this discharge lamp is very high and is in the range of 8000 to 10000 V, and only by application of a starting aid, this discharge lamp cannot be started by a customary ballast of the conventional 200 V mercury vapor discharge lamp.

SUMMARY OF THE INVENTION

Therefore, the present invention is to provide a high pressure metal vapor discharge lamp having a novel starting aid circuit, in which the above-mentioned problems involved in the conventional techniques are solved.

More specifically, it is a primary object of the present invention to provide a high pressure metal vapor discharge lamp including Xe gas confined therein under a relatively high pressure and having an improved starting aid circuit which makes it possible to easily start the discharge lamp by a customary ballast for a conventional 200 V mercury vapor discharge lamp.

A secondary object of the present invention is to provide a high pressure metal vapor discharge lamp including the above-mentioned improved starting aid circuit, in which the problem of dielectric breakdown caused by a high voltage pulse at the time of re-starting after stopping is solved.

In accordance with the present invention, these objects can be attained by a high pressure metal vapor discharge lamp comprising a first starting aid circuit including a starting aid and a first thermal switch and a second starting aid circuit including a resistive element and a second thermal switch, both of said first and second starting aid circuits being disposed within an outer envelope of the discharge lamp, wherein the reset time of the first thermal switch is shorter than the reset time of the second thermal switch.

In the present invention, by virtue of this characteristic structure, even if Xe gas is confined as an inert gas under a relatively high pressure, the discharge lamp can easily be started by a customary ballast for a conventional 200 V mercury vapor discharge lamp. Furthermore, even if the discharge lamp is re-started after a short period of stopping, since the first thermal switch is reset earlier than the second thermal switch without fail, a high voltage pulse is absorbed by an arc tube. Therefore, dielectric breakdown of constituent elements of the lamp by non-resetting of the first thermal switch can be completely prevented. Consequently, the high pressure metal vapor discharge lamp having a high luminous efficacy according to the present invention can be stably started through a customary ballast for a conventional 200 V mercury vapor discharge lamp without occurrence of dielectric breakdown, and hence, the reliability can be remarkably increased.

DETAILED DESCRIPTION OF THE PREFERRED EMBODIMENTS

Figure 1:
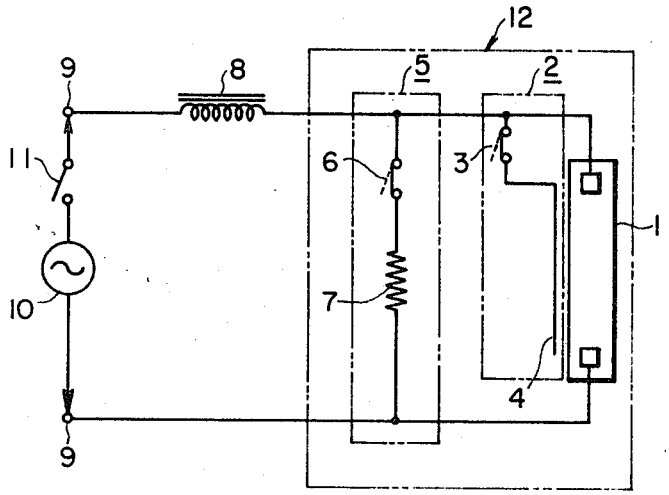
FIG. 1 is a schematic diagram illustrating the basic structure of the high pressure metal vapor discharge lamp according to the present invention.

The inventor made researches with a view to developing means for making it possible to start a discharge lamp including Xe gas confined therein under a relatively high pressure by a customary ballast for a conventional 200 V mercury vapor discharge lamp, and tried to combine the above-mentioned first starting aid circuit comprising a starting aid and a first thermal switch with a second starting aid circuit such as described below. This second starting aid circuit is a series circuit comprising a second thermal switch and a resistive element, which is connected in parallel to an arc tube. The single use of this starting aid circuit has already been proposed in U.S. Pat. No. 4,135,114.

By using the above-mentioned first starting aid circuit comprising a starting aid and a first thermal switch and the above-mentioned second starting aid circuit comprising a resistive element and a second thermal switch in combination, even a discharge lamp including Xe gas confined therein under a relatively high pressure can easily be started by a customary ballast for a conventional 200 V mercury vapor discharge lamp.

However, a discharge lamp comprising the above-mentioned first and second starting aid circuits involves one problem described below. This problem is raised when the discharge lamp is re-started just after stopping. More specifically, at the time of first starting, since the ambient temperature is low, the first and second switches of the first and second starting aid circuits are completely closed even if they differ in the characteristics. Accordingly, when a power source voltage is applied, a starting high voltage pulse of about 6000 V is generated by the ballast and the second starting aid curcuit and is applied to both the ends of the arc tube in which the starting voltage is lowered by the first starting aid circuit, whereby the discharge lamp is started.

However, when the lamp is put off for some reason or other and it is started again after a certain period of stopping, the first and second thermal switches are not absolutely closed. Especially when a power source voltage is applied after resetting of the second thermal switch but before resetting of the first thermal switch, the starting high voltage pulse is not absorbed by the arc tube. At ordinary starting, about 3000 V of the total amplitude of about 6000 V is absorbed by the arc tube, but in the above-mentioned case, the starting high voltage pulse is hardly absorbed by the arc lamp. In other words, this high voltage pulse of about 6000 V is applied to other constituent elements such as both the terminals of the ballast, both the terminals of the socket and wirings. More specifically, at ordinary starting, the pulse voltage applied to these elements is about 3000 V and no particular trouble is caused, but if this voltage is as high as about 6000 V, there is a fear of occurrence of dielectric breakdown between the constituent elements, with the result that the reliability of the discharge lamp is drastically degraded. In the present invention, this problem is solved by the arrangement in which the reset time of the first thermal switch is shorter than the reset time of the second thermal switch. If this arrangement is adopted, even if the discharge lamp is re-started after a certain short period of stopping, the first thermal switch is always reset earlier than the second thermal switch, and hence, the high voltage pulse generated by the second starting aid circuit is inevitably absorbed by the arc tube, with the result that dielectric breakdown of constituent elements of the lamp by the high voltage pulse can be completely prevented.

Referring to FIG. 1 illustrating the basic structure of the high pressure metal vapor discharge lamp according to the present invention, an arc tube 1 of a high pressure sodium vapor discharge lamp is composed of a light-transmitting alumina ceramic tube having an electrode spacing of 78 mm and an inner diameter of 7.9 mm. About 45 mg of sodium-mercury amalgam comprising 60 mol % of Na is confined in the arc tube, and Xe gas is confined under about 350 Torr as an inert gas. A first starting aid circuit 2 comprises a first thermal switch 3 and a starting aid 4, and a second starting aid circuit 5 comprises a second thermal switch 6 and a resistive element 7 (filament coil). Reference numeral 8 represents a customary ballast for a conventional 200 V mercury vapor discharge lamp. A 200 V service alternating current power source 10 is connected between terminals 9 through a switch 11. The portion 12 surrounded by a broken line is arranged within an outer envelope (not shown).

The operation of this discharge lamp at the time of start will now be described in brief.

When the switch 11 is closed, the voltage of the 200 V service alternating current power source 10 is applied between the terminals 9, and the electrode potential of one end of the arc tube 1 is applied to the start aid 4 through the closed thermal switch 3 in the first starting aid circuit 2. The other end of the starting aid 5 extends to the vicinity of the electrode of the other end of the arc tube 1 along or in close proximity to the outer surface of the arc tube 1. Accordingly, the starting voltage of the arc tube 1 is considerably lowered and the discharge lamp is kept in the state where it is readily started. In the second starting aid circuit 5, an electric current flows in the resistive element 7 through the closed thermal switch 6. The resistive element 7 composed of a filament coil exerts a function of regulating the value of this electric current and simultaneously, it acts as a heat source for opening and closing the thermal switch 6. Accordingly, when the ambient temperature of the thermal switch 6 arrives at a certain level, the thermal switch 6 is opened. During this transitional period, in a so-called resistance-inducing inductance circuit comprising the ballast 8 and the resistive element 7, a high voltage pulse is generated between both the terminals of the ballast 8 in the state overlapped to the power source voltage. When this high voltage pulse is applied between the electrodes on both the terminals of the arc tube 1, the arc tube 1 starts discharge and the lamp is started. When the lamp is thus started, the thermal switch 3 is opened by the heat generated by the arc tube 1, and the thermal switch 6 is kept opened by the heat generated by the arc tube 1.

Each of the thermal switches 3 and 6 has a width of 3 mm, a thickness of 0.25 mm and an operational length (the distance between the center of the contact and the center of the fulcrum) of 16 mm.

In order to realize the feature that the reset time of the thermal switch 3 is shorter than the reset time of the thermal switch 6, there may be adopted at least 3 following methods.

(1) A method in which thermal switches of the same specifications, that is, thermal switches having the same opening-closing temperatures, are used and they are arranged in places different in the ambient temperature.

According to this method, the thermal switch 3 is arranged in an appropriate place having a lower ambient temperature than that of the place where the thermal switch 6 is arranged (the intended effect is attained if the difference of the ambient temperature is at least about 50° C.), whereby the first thermal switch 3 is reset earlier than the thermal switch 6 with certainty.

(2) A method in which thermal switches differing in the specifications, for example, thermal switches differing in the contact pressure (the pressure between the contacts when the thermal switch is closed at room temperature), are arranged in appropriate places having the same ambient temperatures.

According to this method, a thermal switch having a higher contact pressure than that of the thermal switch 6 is used as the thermal switch 3 (the intended effect is attained if the difference of the contact pressure is at least about 20 g), whereby the thermal switch 3 is reset earlier than the thermal switch 6 with certainty even if both the switches are arranged in places of the same ambient temperature.

(3) A method in which both the methods (1) and (2) are adopted in combination, that is, thermal switches differing in the specification, for example, the contact pressure, are arranged in places differing in the ambient temperature.

According to this method, a thermal switch having a higher contact pressure than that of the thermal switch 6 is used as the thermal switch 3 and this thermal switch 3 is arranged in an appropriate place having a lower ambient temperature than that of the place where the thermal switch 6 is arranged, whereby the thermal switch 3 is reset earlier than the thermal switch 6 more assuredly.

Results of one of experiments made on the above method (3) are shown in the following table.

TABLE

| | Thermal Switch 3 | Thermal Switch 6 |
|---|---|---|
| Ambient Temperature of Set Place | 300° C. | 370° C. |
| Contact Pressure | 60 g | 30 g |
| (Operation Temperature) | (180° C.) | (120° C.) |
| Reset Time | 3 minutes and 30 seconds | 5 minutes and 0 second |

In the above experiment, the ambient temperature of the place where the thermal switch is to be arranged can be known from the temperature distribution determined by a thermistor located within the envelope of the discharge lamp which is actuated. Thus, the thermal switches 3 and 9 are arranged in optimum places. Discharge lamps of the same type show substantially the same temperature distribution. Accordingly, it is sufficient if optimum places are determined with respect to one discharge lamp. The dimensions of the thermal switches used in the experiment are the same as described above.

As will readily be understood from the experimental results shown in the above table, the thermal switch 3 is reset earlier by 1 minute and 30 seconds than the thermal switch 6. Incidentally, in the above experiment, the starting aid 4 used is one composed of a conductor wound by two turns between the electrodes.

Figure 2:
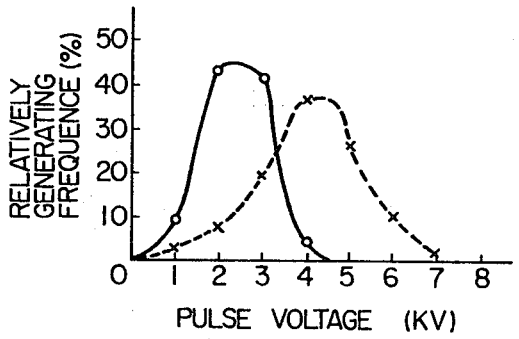
FIG. 2 is a graph showing the effects attained by the present invention.

The effects attained by the feature that the thermal switch 3 is reset earlier than the thermal switch 6 will now be described with reference to FIG. 2. In FIG. 2, the abscissa indicates the amplitude (KV unit) of the high voltage pulse and the ordinate indicates the amplitude frequency of the high voltage pulse expressed in terms of the relatively generating frequency (%) which is represented by the following formula:

$$\text{Relatively generating frequency (\%)} = \frac{\text{frequency of generation of certain voltage}}{\text{frequency of re-starting}} \times 100$$

Namely, re-starting is repeated 80 times and the frequency of the pulse voltage generated between both the terminals of the arc tube (the value of the voltage after absorption by the arc tube) is measured. Accordingly, frequencies of the generated pulse voltages divided by every one KV are plotted and a graph is drawn by connecting top ends of bars of frequencies (%) of the respective pulse voltages. In FIG. 2, a curve 13 of a broken line illustrates the voltage distribution of a conventional discharge lamp (the thermal switch 3 is reset later than the thermal switch 6), and a curve 14 of a solid line illustrates the voltage distribution of the discharge lamp according to the present invention. The amplitude of the generated high voltage pulse varies to some extent depending on the phase of the alternating current where the discharge lamp is started. As is seen from FIG. 2, the distribution of the curve 14 is shifted to the left, that is, the lower voltage side, as compared with the distribution of the curve 13. When both the distributions are compared in respect to the pulse voltage value of a highest frequency, it is seen that this voltage is about 4300 V in the conventional discharge lamp, whereas this voltage is about 2500 V in the discharge lamp according to the present invention. This means that in the conventional discharge lamp, since the thermal switch 6 is reset before resetting of the thermal switch 3, at the time of re-starting, the high voltage pulse generated is hardly absorbed or damped by the arc tube. In contrast, in the discharge lamp according to the present invention, since the thermal switch 3 is reset before resetting of the thermal switch 6 without fail, at the time of re-starting, the high voltage pulse generated is inevitably absorbed and dampered by the arc tube. Accordingly, the high voltage pulse is not applied to the ballast or the like and no dielectric breakdown is caused.

Means for setting the starting aid 4 in the first starting aid circuit 2 is not limited to the method described hereinbefore. Any of other methods can be adopted so far as the thermal switch used can apply a certain voltage to the starting aid and can cut application of this voltage. Furthermore, the resistive element 7 in the second starting aid circuit 5 may be composed of a filament coil or of a combination of a filament coil with a fixed resistance. Moreover, the circuit structure is not limited to one described hereinbefore, and the thermal switch is not limited to the type described hereinbefore but any of thermal switches of other types may be used.

As will be apparent from the foregoing illustration, since the high pressure metal vapor discharge lamp according to the present invention comprises first and second starting aid circuits, the starting characteristic is remarkably improved, and since the reset times of thermal switches of the first and second starting aid circuits are specifically regulated, the high voltage pulse generated by a customary ballast for a conventional 200 V mercury vapor discharge lamp and the second starting aid circuit is not applied to constituent elements of the discharge lamp other the arc tube or to the ballast. Accordingly, occurrence of dielectric breakdown in these elements can be completely prevented. Therefore, a stable high pressure metal vapor discharge lamp having a high reliability can be provided according to the present invention.

What is claimed is:

1. A starting device for a high pressure metal vapor discharge lamp which includes an inner envelope containing therein spaced electrodes, and an outer envelope surrounding said inner envelope, comprising:

(a) a first starting aid for lowering the starting voltage comprising a conductor disposed adjacent to the outer wall of said inner envelope;

(b) a first thermal switch coupling said conductor to one of said electrodes;

(c) and a second starting aid for generating a high voltage pulse comprising a resistive element and a second thermal switch coupled between said electrodes;

(d) both of said first and second starting aid circuits disposed within said outer envelope; and (e) the reset time of said first thermal switch selected to be shorter than the reset time of said second thermal switch, whereby said second starting aid will not be able to generate a high voltage pulse at a time when said first starting aid is not operating, thereby avoiding the dangers of dielectric breakdown within said discharge lamp.

2. The starting circuit of claim 1 wherein Xe gas is confined within said inner envelope.

3. The starting device according to claim 1 wherein said first and second thermal switches have the same opening and closing characteristics and said first thermal switch is disposed in a location within said envelope having a lower ambient temperature than the location of said second switch.

4. The starting device according to claim 1 wherein said first and second switches are disposed at locations having the same ambient temperature with said second switch having a higher contact pressure than said first switch, whereby said first switch will be reset earlier than said second switch at the same temperature.

5. The starting device according to claim 1 wherein said first and second switches have different characteristics which causes said first switch to close before said second switch.

6. The starting device according to claim 5 wherein said first switch has a characteristic causing it to close at a lower temperature than said second thermal switch and wherein said first switch is also disposed within the said envelope at a point of lower ambient temperature.

* * * * *